US005378321A

United States Patent [19]

Delcourt

[11] Patent Number: 5,378,321

[45] Date of Patent: Jan. 3, 1995

[54] VARYING ANNULAR FLUIDIZATION ZONE FOR INCREASED MIXING EFFICIENCY IN A MEDIUM CONSISTENCY MIXER

[75] Inventor: Thomas R. Delcourt, Glens Falls, N.Y.

[73] Assignee: Kamyr, Inc., Glens Falls, N.Y.

[21] Appl. No.: 115,133

[22] Filed: Sep. 1, 1993

Related U.S. Application Data

[62] Division of Ser. No. 845,713, Mar. 4, 1992, Pat. No. 5,263,774.

[51] Int. Cl.[6] ..... D21C 3/22; B01F 5/04

[52] U.S. Cl. ..... 162/57; 162/243; 366/171; 366/172; 366/305; 366/307

[58] Field of Search ..... 366/79, 81, 82, 90, 366/96–99, 155, 168, 171, 172, 262–266, 279, 303–307, 309, 318, 319, 342, 343; 415/71, 72; 416/176, 223 B; 162/57, 243

[56] References Cited

U.S. PATENT DOCUMENTS

| | | | |
|---|---|---|---|
| 612,317 | 10/1898 | Dundon | 366/263 |
| 2,190,896 | 2/1940 | Underwood | 366/265 |
| 2,969,960 | 1/1961 | Gurley, Jr. | 366/303 |
| 2,970,817 | 2/1961 | Gurley, Jr. | 366/305 |
| 3,284,055 | 11/1966 | Johansen | 162/243 X |
| 3,471,131 | 10/1969 | Fritzweiler et al. | 366/318 X |
| 3,532,151 | 10/1970 | Hachiya et al. | 366/300 X |
| 4,174,907 | 11/1979 | Suh et al. | 366/318 X |
| 4,175,871 | 11/1979 | Suh et al. | 366/318 X |
| 4,295,925 | 10/1981 | Bentrelzen et al. | 162/243 X |
| 4,339,206 | 7/1982 | Ahs | 366/307 |
| 4,577,974 | 3/1986 | Prough et al. | 366/307 |
| 4,675,033 | 6/1987 | Fellman et al. | 55/203 |
| 4,820,381 | 4/1989 | Brown | 162/57 X |
| 4,834,547 | 5/1989 | Niskanen | 366/165 |
| 4,854,819 | 8/1989 | Gullichsen | 415/143 |
| 4,877,368 | 10/1989 | Timperi et al. | 415/143 |
| 4,908,101 | 3/1990 | Frisk et al. | 366/307 X |
| 4,964,950 | 10/1990 | Niskanen et al. | 366/156 X |

FOREIGN PATENT DOCUMENTS

| | | | |
|---|---|---|---|
| 1102604 | 6/1981 | Canada . | |
| 1959139 | 6/1970 | Germany | 366/99 |
| 882766 | 11/1981 | U.S.S.R. | 366/79 |
| 1007714 | 3/1983 | U.S.S.R. | 366/343 |
| 1421385 | 9/1988 | U.S.S.R. | 366/318 |

OTHER PUBLICATIONS

International Technical Disclosures, ITD 1:9, vol. 1, No. 9, Jul. 25, 1983.

*Primary Examiner*—David A. Scherbel
*Assistant Examiner*—Charles Cooley
*Attorney, Agent, or Firm*—Nixon & Vanderhye

[57] ABSTRACT

Medium consistency (e.g. about 5–18%) paper pulp is mixed with a treatment fluid by fluidizing them while subjecting them to a constantly changing shear field in radial and axial planes. This is accomplished by providing a mixer rotor having a constantly varying cross-section along a dimension of elongation. The rotor may comprise a body having an external surface simulating alternately oriented cone frustums along its axis of rotation, with vanes connected to the external surface and including portions following the surface contour. A disk may or may not be provided at the end of the body connected to a shaft. A first interior housing portion has a configuration mimicking that of the rotor, while a second housing portion defines a fluidization zone with the disk.

7 Claims, 4 Drawing Sheets

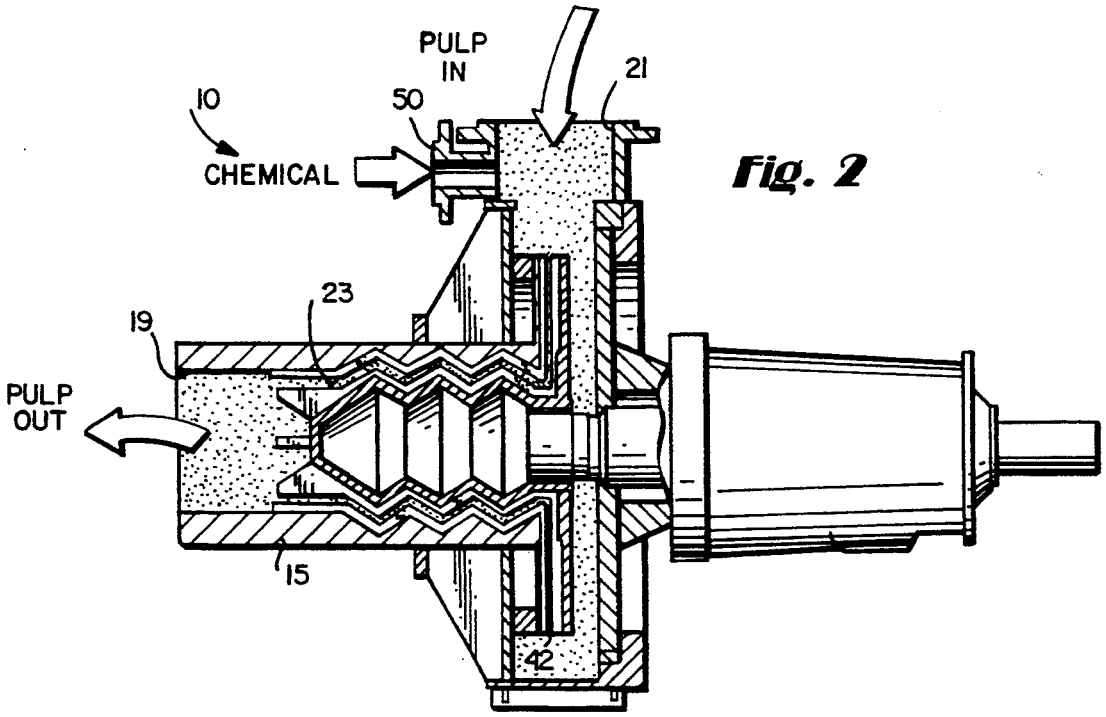
Fig. 2
Fig. 4
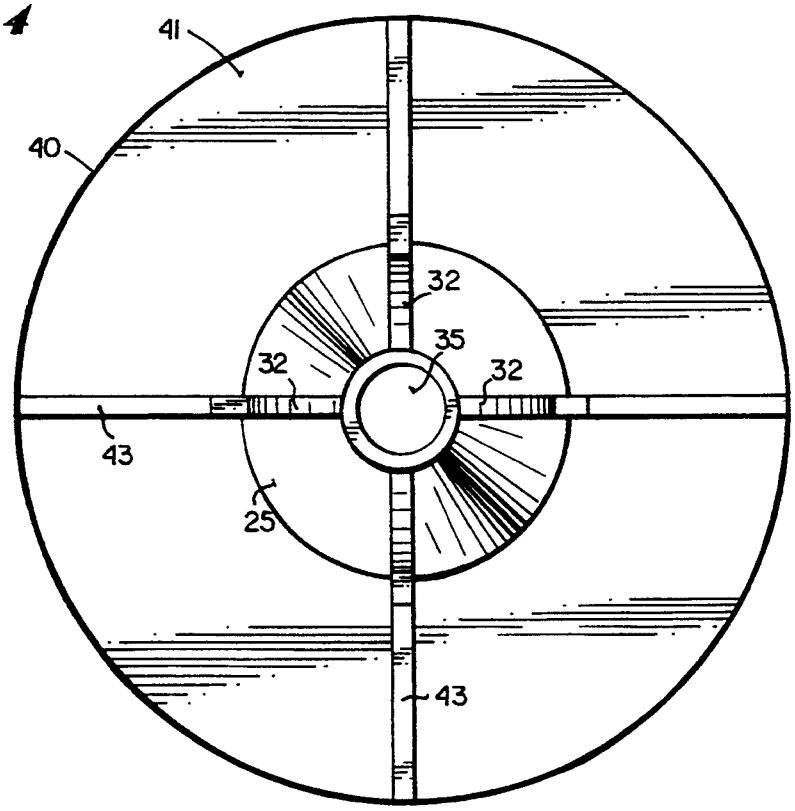

VARYING ANNULAR FLUIDIZATION ZONE FOR INCREASED MIXING EFFICIENCY IN A MEDIUM CONSISTENCY MIXER

This is a division of application Ser. No. 07/845,713, filed Mar. 4, 1992 now U.S. Pat. No. 5,263,774.

BACKGROUND AND SUMMARY OF THE INVENTION

For many processes in the pulp and paper field it is desirable to be able to mix chemicals in fluid form (whether gaseous or liquid) into medium consistency pulp (typically pulp having a consistency of about 5–18%). In order to effectively do this, it is necessary that the pulp suspension (which is comminuted cellulosic fibrous material) be fluidized. This may be accomplished, for example, by causing the pulp with chemical to flow in an annulus while an impeller, which comprises one of the components defining the annulus and having lobes or vanes, is rotated at extremely high speed, a speed sufficient to effect fluidization. For example, see U.S. Pat. Nos. 4,339,206 and 4,577,974 and Canadian Patent 1,102,604. While such mixers do normally provide a suitable mixing action, because of the small residence time of the pulp and chemical in the fluid mixing zones, the efficiency of the mixing is not always as good as desired. Therefore, according to the present invention, the efficiency of a medium consistency mixer is desirably increased.

According to the present invention, a mixer, and method of mixing, suitable for use with medium consistency pulp are provided which increase the efficiency of the mixer compared to the conventional prior art by intensifying the turbulent action in at least one fluidized zone. This is accomplished, according to the present invention, by constantly changing the annular fluidization zone so as to subject the pulp to an unsteady-state shear field. According to the present invention, rather than subjecting the pulp to merely one field at a time, e.g., a field in the axial plane where the pulp velocity is a function of the cross section of the annulus, it is subjected to two transverse fields simultaneously. According to the invention, one shear field is generated in a radial plane where shear is a function of radius for a given rotational speed, while another shear field is contemporaneously generated in the axial plane. This unsteady-state shear field in two planes increases the mixing efficiency significantly.

According to one aspect of the present invention, a method of mixing a fluid with cellulosic pulp having a consistency of about 5–18% throughout mixing is provided which comprises the following steps: (a) Introducing the fluid and the pulp having a consistency of about 5–18% into a first fluidization annulus in a first fluidization zone. (b) In the first fluidization annulus in the first fluidization zone, fluidizing the pulp while subjecting the pulp and fluid to a constantly changing shear field simultaneously developed in both radial and axial planes; and (c) discharging the pulp, with mixed in fluid, from the first fluidization zone. A second fluidization zone may also be provided, either prior to the first zone, or after it, in which the pulp and fluid are subjected to a constantly changing shear field developed in substantially only one plane (a radial plane).

According to another aspect of the present invention, a mixer is provided, particularly (although not exclusively) for use in the method as described above. The mixer comprises: A housing having a first interior portion encompassing an axial plane, a second interior portion, a first inlet, a second inlet, and an outlet. A rotor. Means for mounting the rotor for rotation about a first axis, within at least the housing first interior portion, the first axis disposed in the axial plane. Means for rotating the rotor about the first axis. The housing first interior portion and the rotor configured so as to define a fluidization zone having a constantly changing configuration creating an ever changing shear field in the axial plane, and in radial planes substantially perpendicular to the axial plane; and the first inlet, second inlet, and outlet spaced so that two different fluids introduced into the fluidization zone by the first and second inlets are mixed before discharge of a mixed fluid through the outlet.

The configuration of the rotor of the mixer described above which results in the desired changing fields in an axial plane and radial plane substantially perpendicular to the axial plane comprises a varying cross section of the rotor along its length. Also, the housing first inner portion has a varying cross section substantially mimicking the varying cross section of the rotor. The rotor may have a disc at a first axial end thereof closest to the rotating means, with the second interior housing portion having a surface defining a fluidization zone with the disc.

The invention also comprises a rotor per se, utilizable in a mixer. The rotor according to the invention is unique in that it comprises a body element elongated in a dimension of elongation, and having an external surface with a continuously varying cross-sectional area along a major portion of the body element in the dimension of elongation. Preferably, this is provided by an external surface shaped to simulate a plurality of alternately oriented cone frustums. A plurality of vanes are connected to the body element, including portions of the vanes generally following the contour of the body element external surface. Finally, a means for connecting the rotor to a shaft is provided. Optionally, a disc may be disposed in a plane perpendicular to the dimension of elongation of the body element, the disc disposed adjacent the means for connecting the rotor to a shaft. Continuations of the vanes may be provided from the body element onto the disc (e.g., radially extending on the disc), an extension portion may extend axially from the body element in the dimension of elongation, from a second axial end opposite the connection to a shaft. The number of vanes and their position may vary widely, but in exemplary embodiment four evenly spaced parallel straight vanes may be provided.

It is a primary object of the present invention to provide for enhanced mixer efficiency, including utilizing a uniquely constructed rotor, and in a preferred embodiment for acting upon medium consistency pulp. This and other objects will become clear from an inspection of the detailed description of the invention and from the appended claims.

BRIEF DESCRIPTION OF THE DRAWINGS

FIG. 2 is a view like that of FIG. 1 for a second embodiment of housing of the mixer;

FIG. 4 is a top plan view of the rotor of FIG. 3; and

DETAILED DESCRIPTION OF THE DRAWINGS

Figure 1:
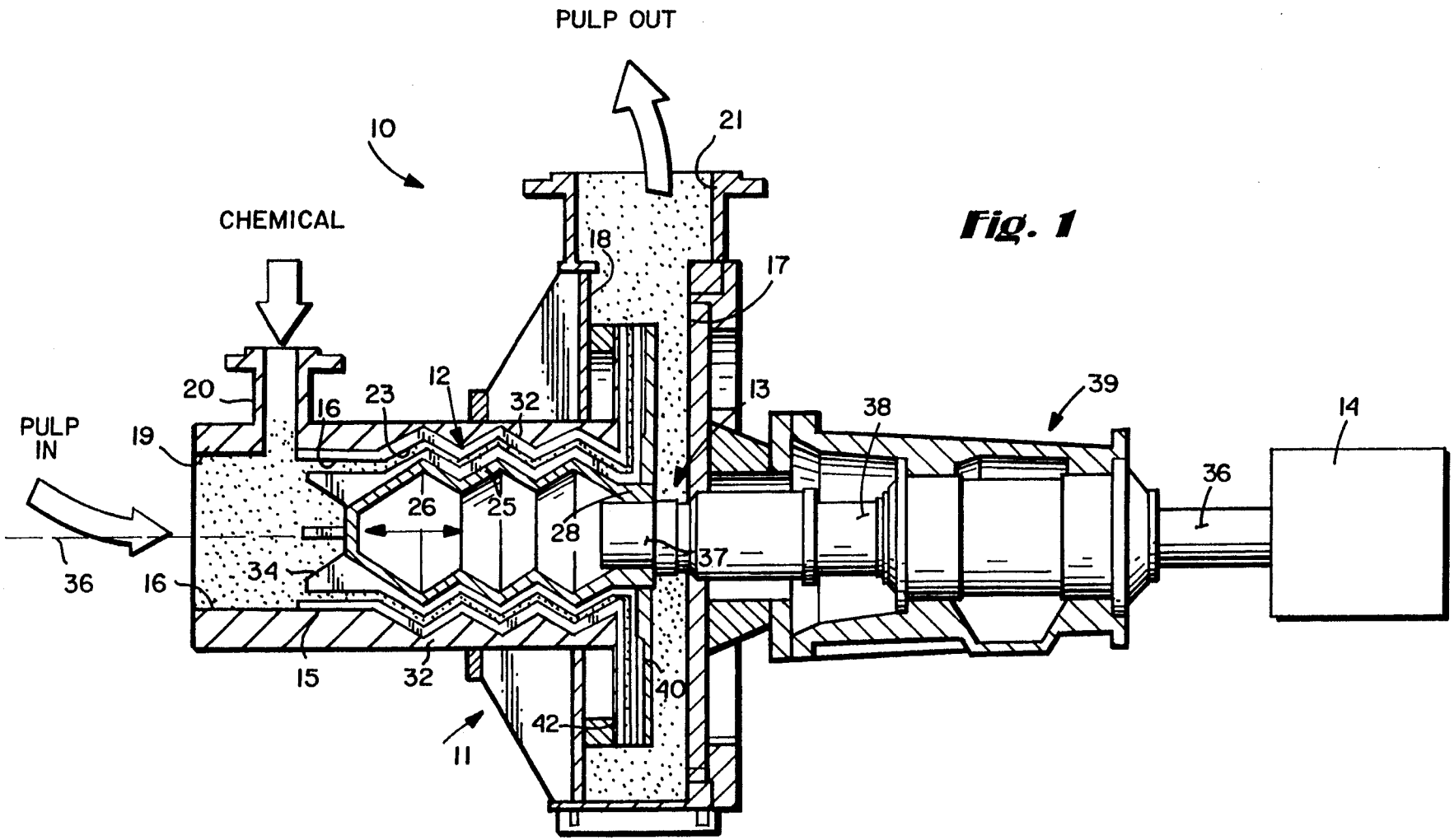
FIG. 1 is a side cross-sectional view of a first embodiment of a mixer according to the invention.

An exemplary mixer according to the present invention is shown generally by reference numeral 10 in FIG. 1. The main components of the mixer 10 include the housing 11, the rotor 12, the shaft 13 and a motor 14 or the like for powering the shaft 13.

The housing 11 preferably comprises a first portion, which may be referred to as the axial portion, 15 having an interior 16, and a second portion, which may be referred to as a radial portion, 17, having an interior 18. The housing 11 includes two inlets, a first inlet 19 for cellulosic pulp, or similar fluid, and a second inlet 20 for a chemical agent with which to treat the pulp. The chemical agent introduced at the second inlet 20 normally is a fluid, such as a treatment liquid or gas, which is desirably intimately mixed with the pulp introduced into the inlet 19. The inlets 19, 20 in the embodiment of FIG. 1 are in the axial portion 15 of the housing 11. An outlet 21 for pulp intimately mixed with treatment chemical is provided in the second or radial housing portion 17.

The rotor 12 and the housing interior axial portion 16 are constructed so as to define an annulus 23 therebetween. Pulp and chemical to be mixed into the pulp are caused to flow in the annulus 23 as the material advances from the inlets 19, 20 to the outlet 21. According to the present invention, the annulus 23 is constructed in such a way as to provide an unsteady-state shear field in two (radial and axial) transverse planes, which increases the mixing efficiency.

The rotor 12 preferably is a body element 25 axially elongated, that is in the dimension of elongation 26. The body element 25 may be solid or hollow, and of metal or a composite material having sufficient strength to satisfy the requirements of use.

Figure 3:
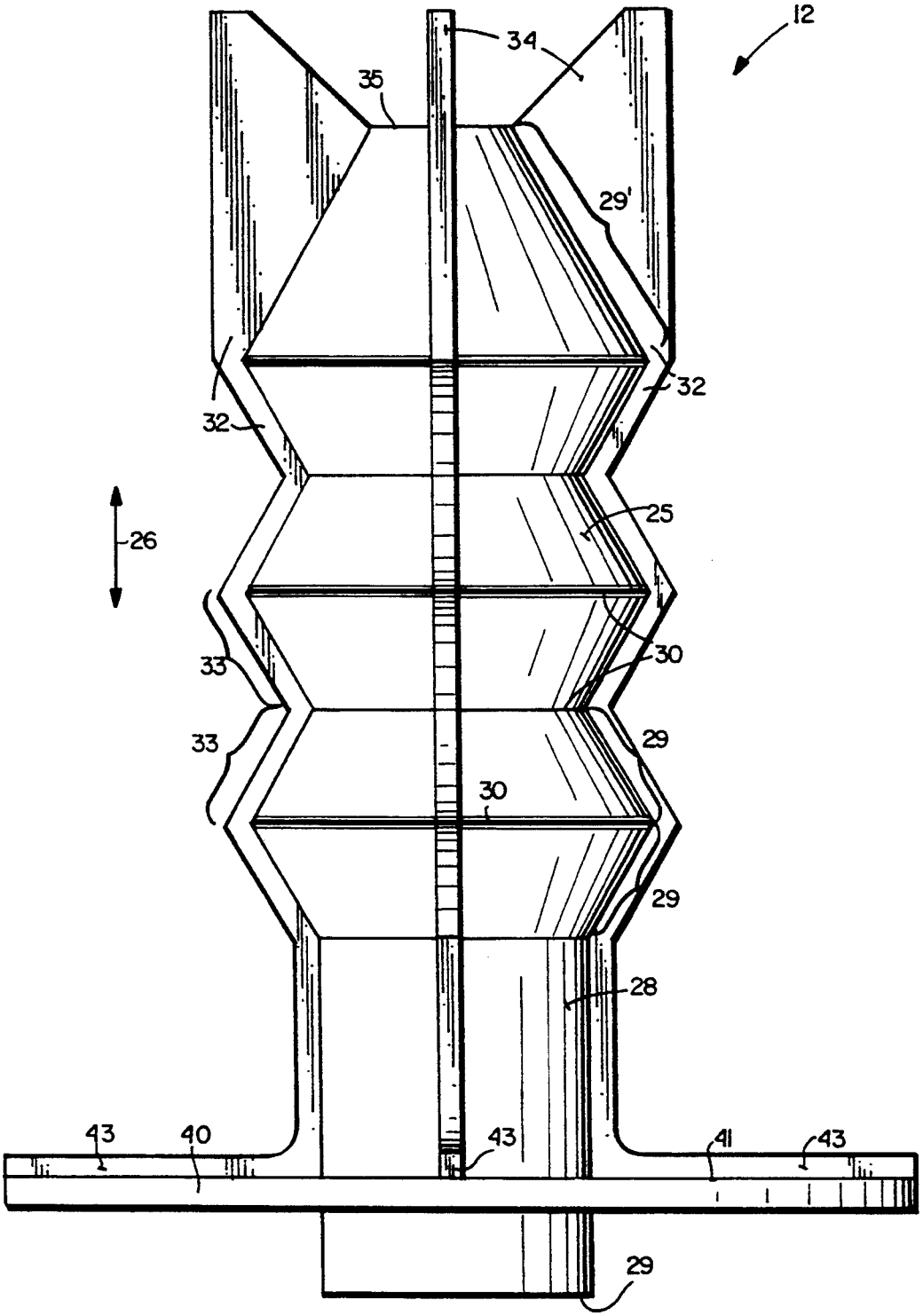
FIG. 3 is a side elevational view of an exemplary rotor according to the invention.

As seen in FIG. 3, the body 25 has an external surface with a continuously varying cross-sectional area along the major portion of the body element 25 in the dimension of elongation 26. For the specific embodiment actually illustrated in FIG. 3, the body 25 cross section continuously varies except at the hub 28 provided adjacent a first end 29 thereof. In the preferred embodiment illustrated in the drawings, the external surface of the body element 25 simulates a plurality of alternately oriented cone frustums 29. For example, frustums 29 may be frustums of right circular cones (generated by rotating the hypotenuse of a right triangle about a central axis). It is not necessary that all of the frustums 29 have the same length in the dimension 26, it is only necessary that at the lines 30 where they abut that they have the same cross-sectional area and dimension. Note, for example, that the top frustum 29' illustrated in FIG. 3 is about twice as long as the other frustums 29. The angle the surface of a frustum makes to the vertical (as viewed in FIG. 3) is preferably about 10°60° (e.g. 30°).

The rotor 12 also preferably comprises a plurality of metal vanes, illustrated by reference numeral 32 in FIGS. 1 and 3, connected (e.g., welded) to the body element 25. The vanes 32 preferably have portions—such as the portions 33 illustrated in FIG. 3—which generally follow the contour of the body element 25 external surface. Any number of vanes 32 may be provided, as well as a wide variety of configurations. For simplicity, however, it is preferred that a plurality (e.g. four ) vanes 32 being disposed equally around the circumference of the body 25, as illustrated in FIG. 4. The vanes 32 illustrated in FIGS. 3 and 4 are also shown to be straight and elongated in the dimension 26, although they could be helical, angled, or otherwise disposed depending on particular circumstances.

The vanes 32 also may have extension portions, illustrated by reference numeral 34 in FIGS. 1 and 3, which extend in the dimension 26 past the flat first end 35 of the body element 25.

The rotor 12 also comprises means for connecting the rotor 12 to the shaft 13 so that it is rotatable about an axis 36 (see FIG. 1). A connection means may comprise any suitable mechanical connection, such as a key connection between a first end 37 of the shaft 13 and interior surface of the hub 28. The shaft 13 mounted by bearing means 39 and connected to a conventional motor 14 drives the rotor 12 at a high angular velocity so as to effect fluidization of medium consistency pulp in the annulus 23.

The rotor 12 optionally may include a disc 40 adjacent the first end 29 of the rotor 12. The disc 40 has a top surface 41 which cooperates with the interior housing portion 18 to define another fluidization zone volume 42. The vanes 32 may have continuation portions 43 thereof on the top surface 41 of the disc 40, e.g., radially extending on the disc 40 as illustrated in FIG. 4.

Figure 5:
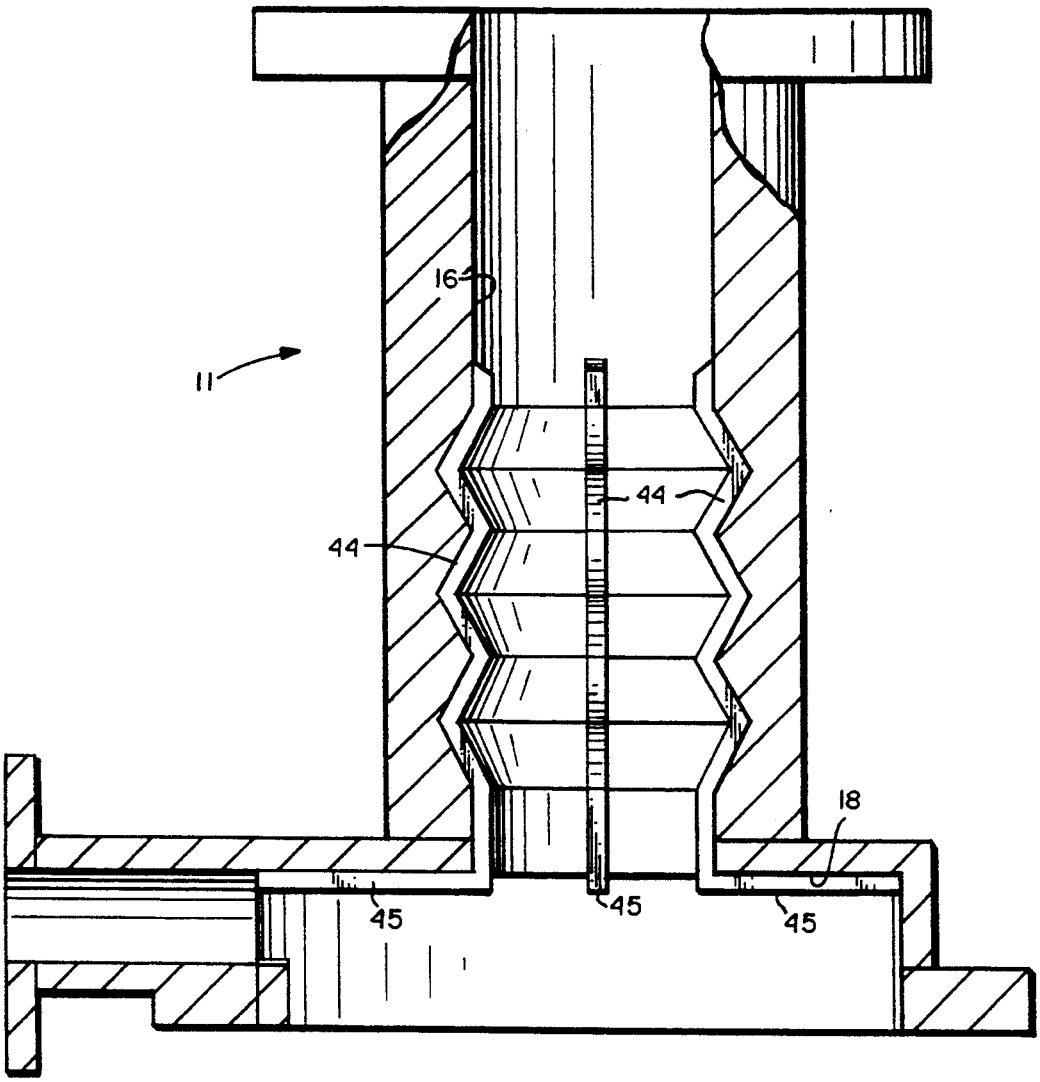
FIG. 5 is a side view, partly in cross section and partly in elevation of the housing of the FIG. 2 embodiment.

The interior housing portions 16, 18 may also have ribs cooperating with the vanes 32, 43. As seen in FIG. 5, ribs 44 (e.g., four ribs) are provided on the interior surface portion 16 which correspond to the ribs 32. Also, the inner surface 16 of the housing, as seen in FIG. 5, has a configuration which mimics that of the external surface of the body 25 of the rotor 12. The inner surface 18 has ribs 45 extending therefrom, which are generally comparable to the ribs 43.

In the utilization of the mixer 10 heretofore described, as illustrated in FIG. 1, the housing first interior portion 16 and the rotor external surface 25 are configured so as to define a fluidization zone 23 having a constantly changing configuration creating an ever changing shear field in an axial plane, and in radial planes substantially perpendicular to the axial plane. Shear is thus generated in the radial plane where it is a function of radius for a given rotational speed, and in the axial plane the pulp velocity is a function of the cross section of the annulus 23. Also, a second fluidization zone 42 has a shear field generated in the radial plane, for further mixing action. Note also that the inlets 19, 20 and outlet 21 are spaced so that two different fluids (e.g., pulp and treatment liquid) introduced into the fluidization zone (annulus 23) are mixed before discharge of the mixed fluid through the outlet 21.

Utilizing the mixer 10, a method of mixing a fluid with cellulosic pulp having medium consistency (e.g., about 5–18%) throughout mixing may be practiced. The method comprises the steps of: (a) Introducing the fluid (through 20), and pulp (through 19) having a consistency of about 5–18%, into a first fluidization annulus 23 in a first fluidization zone (within housing portion 15). (b) In the first fluidization annulus 23, fluidizing the pulp (by high speed rotation of the rotor 12 by the motor 14 through the shaft 13) while subjecting the pulp and fluid to a constantly changing shear field simultaneously developed in both radial and axial planes. And (c) discharging the pulp, with mixed in fluid, from the first fluidization zone (within housing portion 15, through outlet 21). Utilizing the apparatus 10 of FIG. 1, step (c) is practiced to discharge the pulp, with mixed in fluid, into a second fluidization zone 42 in which the pulp with mixed in fluid is fluidized (by high speed rotation of disc 40 with vanes 43 thereon) while subjecting the pulp and fluid to a constantly changing shear field developed substantially only in a radial plane.

FIG. 2 illustrates a mixer virtually identical to that of FIG. 1 only it is run in "reverse". Components identical to those in FIG. 1 are shown by the same reference numeral. The only significant difference in the FIG. 2 embodiment is that the structure 19 is the outlet for pulp with mixed in chemical, while the structure 21 is the first inlet, and the structure 50 is the second inlet, for the chemical (taking the place of the inlet 20 in the FIG. 1 embodiment). When the embodiment of FIG. 2 is operated, the pulp and fluid (introduced at 21 and 50) are passed into the second fluidization zone 42 first, and in that zone 42 the pulp is fluidized while the pulp and the fluid are subjected to a constantly changing shear field developed substantially only a radial plane. Then the pulp moves from the zone 42 into the annulus 23, ultimately being discharged through outlet 19.

While the rotor 12 has been illustrated with a disc 40, the disc 40 is optional. If the mixer 10 is operated without the disc 40, the inlet can be located at any angle between 10° and 90° with respect to the outlet, regardless of the direction of flow of pulp (and pulp with treatment fluid).

It will thus be seen that according to the present invention the annular cross section through which the pulp and fluid to be intimately mixed therewith move varies, which generates an unsteady state shear field in two transverse planes thereby increasing the mixing efficiency.

While the invention has been described in connection with what is presently considered to be a preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of mixing a fluid with cellulosic pulp having a consistency of about 5–18% throughout mixing, comprising the steps of:

(a) passing the fluid and pulp at a consistency of about 5–18% into a first fluidization zone in which the pulp is fluidized while subjecting the pulp and fluid to a constantly changing shear field developed substantially only in a radial plane;

(b) introducing the fluid and the pulp having a consistency of about 5–18% into a second fluidization annulus in a second fluidization zone;

(c) in the second fluidization annulus in the second fluidization zone, fluidizing the pulp while subjecting the pulp and fluid to a constantly changing shear field simultaneously developed in both radial and axial planes; and (d) discharging the pulp, with mixed in fluid, from the second fluidization zone.

2. A mixer comprising:

a housing having a first interior portion encompassing an axial plane, a second interior portion, a first inlet, a second inlet, and an outlet;

a rotor mounted for rotation about a first axis, within at least said housing first interior portion, said first axis disposed in said axial plane;

a shaft for rotating said rotor about said first axis, and connected to said rotor:

said housing first interior portion and said rotor configured so as to define a fluidization zone having a constantly changing configuration creating an ever changing shear field in said axial plane, and in radial planes substantially perpendicular to said axial plane;

said first inlet, second inlet, and outlet spaced so that two different fluids introduced into said fluidization zone by said first and second inlets are mixed before discharge of a mixed fluid through said outlet; and wherein said rotor comprises: an elongated body element having an axis and having an external surface shaped to simulate more than two contiguous cone frustums alternately oriented along the length of the body element, and defining an external contour; and a plurality of vanes connected to said body element including portions thereof generally following the external contour of said body element from one cone frustum to another, said vanes being coplanar with said axis.

3. A mixer comprising:

a housing having a first interior portion encompassing an axial plane, a second interior portion, a first inlet, a second inlet, and an outlet;

a rotor mounted for rotation about a first axis, within at least said housing first interior portion, said first axis disposed in said axial plane;

a shaft, for rotating said rotor about said first axis, and connected to said rotor;

said housing first interior portion and said rotor configured so as to define a fluidization zone having a constantly changing configuration creating an ever changing shear field in said axial plane, and in radial planes substantially perpendicular to said axial plane;

said first inlet, second inlet, and outlet spaced so that two different fluids introduced into said fluidization zone by said first and second inlets are mixed before discharge of a mixed fluid through said outlet; and wherein said rotor comprises: an elongated metal body element having an axis, and having a continuous external surface with a continuously varying cross-sectional area along a major portion of said body element along said axis, and defining an external contour; a plurality of vanes connected to said body element including portions thereof generally following the external contour of said body element, said vanes being coplanar with said axis; and a disk disposed in a plane perpendicular to said axis of said body element, said disk disposed adjacent to where said rotor is connected to said shaft.

4. A mixer as recited in claim 3 wherein said rotor further comprises continuations of said vanes extending radially from said body element onto said disk.

5. A mixer as recited in claim 3 wherein said rotor consists of said body element, said vanes, and said disk.

6. A mixer as recited in claim 3 wherein said plurality of vanes of said rotor comprises at least four vanes, said vanes evenly spaced around said body element.

7. A mixer comprising:

a housing having a first interior portion encompassing an axial plane, a second interior portion, first and second inlets, and an outlet;

a rotor having a varying cross-section along its length and shaped to simulate a plurality of alternately oriented cone frustums and having an external surface with a contour, and a plurality of vanes connected thereto including portions thereof generally following the contour of the external surface, the rotor mounted for rotation about a first axis within at least said housing first interior portion, said first axis disposed in said axial plane, and said housing interior portion has a plurality of ribs cooperating with said vanes; and wherein said rotor includes a disk at a first axial end thereof, and wherein said second interior housing portion has a surface defining a fluidization zone with said disk.

* * * * *